US007986892B2

(12) United States Patent
Maeyama et al.

(10) Patent No.: US 7,986,892 B2
(45) Date of Patent: Jul. 26, 2011

(54) IMAGE FORMING APPARATUS HAVING A CONTROLLER FOR CONTROLLING A DEVELOPER

(75) Inventors: Takeshi Maeyama, Ikeda (JP); Toshiya Natsuhara, Takarazuka (JP); Junya Hirayama, Takarazuka (JP); Shigeo Uetake, Takatsuki (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 399 days.

(21) Appl. No.: 12/231,500

(22) Filed: Sep. 3, 2008

(65) Prior Publication Data

US 2009/0067890 A1 Mar. 12, 2009

(30) Foreign Application Priority Data

Sep. 6, 2007 (JP) ..... 2007-231266
Sep. 22, 2007 (JP) ..... 2007-246312

(51) Int. Cl.
*G03G 15/08* (2006.01)

(52) U.S. Cl. ..... 399/55; 399/282; 399/283; 399/285

(58) Field of Classification Search ..... 399/55, 399/265, 279, 281, 282, 283, 285, 270–273; 430/123.51

See application file for complete search history.

(56) References Cited

U.S. PATENT DOCUMENTS

| | | | | |
|---|---|---|---|---|
| 5,802,430 | A * | 9/1998 | Wada | 399/253 |
| 5,832,350 | A * | 11/1998 | Kumasaka et al. | 399/282 |
| 5,963,768 | A * | 10/1999 | Rhee | 399/283 |
| 5,991,587 | A | 11/1999 | Kikuchi | |
| 6,347,208 | B1 * | 2/2002 | Yamamoto | 399/281 |
| 6,381,424 | B1 * | 4/2002 | Takahashi et al. | 399/55 |
| 6,512,909 | B2 | 1/2003 | Ozawa et al. | |
| 6,721,516 | B2 | 4/2004 | Aoki et al. | |
| 7,263,320 | B2 * | 8/2007 | Hirayama et al. | 399/273 |
| 7,689,150 | B2 * | 3/2010 | Uetake et al. | 399/285 |
| 7,734,227 | B2 * | 6/2010 | Uetake et al. | 399/253 |
| 7,738,814 | B2 * | 6/2010 | Matsuura et al. | 399/253 |
| 7,761,041 | B2 * | 7/2010 | Maeyama et al. | 399/281 |
| 7,835,676 | B2 * | 11/2010 | Goto et al. | 399/270 |
| 2007/0071506 | A1 | 3/2007 | Uetake et al. | |
| 2007/0212122 | A1 * | 9/2007 | Maeyama et al. | 399/267 |
| 2008/0219712 | A1 * | 9/2008 | Hirayama et al. | 399/285 |

FOREIGN PATENT DOCUMENTS

| | | |
|---|---|---|
| JP | 59-100471 | 6/1984 |
| JP | 59-172662 | 9/1984 |
| JP | 01124880 A * | 5/1989 |
| JP | 09-185247 | 7/1997 |
| JP | 10-319708 | 12/1998 |

(Continued)

*Primary Examiner* — Robert Beatty
(74) *Attorney, Agent, or Firm* — Brinks Hofer Gilson & Lione

(57) ABSTRACT

Provided are a developing device and an image forming apparatus, the developing device which employs a two-component developer wherein development hysteresis (ghost) is reduced and deterioration of a carrier is stably suppressed, and high-quality images are thus realized for a long period of time. The developing device, which uses a developer including toner, carrier and reverse polarity particles which are charged to have a polarity reverse to that of the toner, performs a collecting operation for collecting the reverse polarity particles at a timing in which image formation is not affected by a collecting operation, where the reverse polarity particles are accumulated in the area enclosed by a toner carrying member, a developer carrying member for toner supply and developer carrying member for collecting toner are collected into a developer container.

18 Claims, 8 Drawing Sheets

FOREIGN PATENT DOCUMENTS

| | | | | |
|---|---|---|---|---|
| JP | 10-340003 | | | 12/1998 |
| JP | 11249428 | A | * | 9/1999 |
| JP | 2000-298396 | | | 10/2000 |
| JP | 2002-108104 | | | 4/2002 |
| JP | 2003-057882 | | | 2/2003 |
| JP | 2003-215855 | | | 7/2003 |
| JP | 2005-189708 | | | 7/2005 |
| JP | 2007-108673 | | | 4/2007 |

* cited by examiner

IMAGE FORMING APPARATUS HAVING A CONTROLLER FOR CONTROLLING A DEVELOPER

This application is based on Japanese Patent Applications No. 2007-231266 filed on Sep. 6, 2007, and No. 2007-246312 filed on Sep. 22, 2007, in Japanese Patent Office, the entire content of which is hereby incorporated by reference.

TECHNICAL FIELD

The present invention relates to an image forming apparatus such as a photocopier or printer using electro-photographic technology, particularly to an image forming apparatus using a developer including toner and carrier.

BACKGROUND

Two developing methods have been known in the image forming apparatus using electro-photographic technology—a single-component developing method that uses only toner when developing an electrostatic latent image formed on an image carrying member, and a two-component developing method that uses both toner and carrier. The single-component developing method generally allows the toner to pass through a regulating portion formed between a toner carrying member and a regulating plate pressed to the toner carrying member, whereby toner is charged and a desired thin toner layer is obtained. This method provides the advantages in structure simplification, downsizing and cost cutting. In the meantime, it has the disadvantage of easily accelerating toner deterioration due to the great stress of the regulating portion, and easily reducing the toner charge-receiving property. Further, the regulating member as a charge-applying member for applying charge to toner and the toner carrying member surface are contaminated by toner or external additive agent, whereby the charge-applying property to apply charge to the toner is also reduced. Thus, the amount of charge to be given to toner is reduced, with the result that the service life of the developing device is reduced.

By contrast, in the two-component developing method, the stress is small because the toner is charged by triboelectric charging with toner and carrier mixed, and the carrier has a relatively large surface. Hence the carrier has a great resistance to possible contamination by toner or external additive agent, and this method is advantageous for ensuring a longer service life of the developing device. However, in the two-component developing method, when electrostatic latent image is developed on an image carrying member, a magnetic brush formed with developer slides on the image carrying member surface. This raises an image quality problem wherein traces of the magnetic brush remain on the image. Further, the carrier easily sticks to the image carrying member, thereby causing defects in the image.

One of the conventionally known development methods for solving the image quality problem while maintaining the advantage of longer service life of the two-component developing method is the so-called hybrid development method (Japanese Unexamined Patent Application Publication No. S59-172662), wherein a two-component developer is carried on the developer carrying member and, out of the two-component developer, only toner is supplied to a toner carrying member to perform development. However, the hybrid development method includes the problem wherein the residual toner, on the toner carrying member, not having been used for development appears on the image as hysteresis of development (image memory) in the next development process.

When a half-tone image such as gray is outputted immediately after the image of high contrast such as a solid black image on a white background, the previously printed pattern of high contrast appears in the half-tone image. This phenomenon is the aforementioned image memory and due to the unevenness of an image density caused by the unevenness of the toner layer created as follows. A toner layer not having been used for development remains on the toner carrying member corresponding to the printed image pattern after printing of the high contrast image, and unevenness of thickness of the toner layer corresponding to the printed image pattern is created on the toner carrying member after the next toner supply process.

To solve the problem of the image memory in the hybrid development method, a proposal has been made to employ a developer carrying member for collecting the toner, not having been used for development, from a toner carrying member, in addition to a developer carrying member for toner supply which supplies toner to the toner carrying member (Japanese Unexamined Patent Application Publication No. H10-319708). This method ensures that the toner not having been used for development remaining on the toner carrying member is collected onto the developer carrying member for collecting toner, whereby generation of an image memory can be prevented. However, the technique disclosed in the Japanese Unexamined Patent Application Publication No. 10-319708 has a problem that the carrier is deteriorated due to a long-term use and the amount of charge to be charged to toner is reduced, whereby image quality is deteriorated.

The present inventors have made concentrated study efforts to solve the aforementioned problems, and have proposed a technique of achieving a still longer service life in the two-component developing method, wherein the reverse polarity particles having a polarity reverse to that of the charged toner are added to the developer containing both toner and carrier, thereby compensating for the shortage of the charging property of the carrier (Japanese Unexamined Patent Application Publication No. 2007-108673). This technique is also applicable to the hybrid development method, and further prolongs the service life of the hybrid development method. However, the technique disclosed in the Japanese Unexamined Patent Application Publication No. 2007-108673 still has the problem of generating an image memory.

In view of the prior art problems described above, it is an object of the present invention to provide a developing device and an image forming apparatus capable of forming a high-quality image for a long period of time while preventing the occurrence of image memory. Another object of the present invention is to provide a developing device and an image forming apparatus capable of preventing both the occurrence of image memory and reduction in the amount of charge to be charged.

SUMMARY

In view of forgoing, one embodiment according to one aspect of the present invention is an image forming apparatus, comprising:

an image carrying member which is adapted to carry an electrostatic latent image;

a developer container which is adapted to contain a developer including a toner, a carrier for charging the toner, and reverse polarity particles to be charged reverse to a charge polarity of the toner;

a toner carrying member which is adapted to convey a toner to a development position, at which the toner carrying member faces the image carrying member, to develop the electrostatic latent image on the image carrying member;

a first developer carrying member which is adapted to carry the developer supplied from the developer container and is disposed facing the toner carrying member to supply a toner to the toner carrying member;

a second developer carrying member which is adapted to carry a developer and is disposed, to collect the toner on the toner carrying member, facing the toner carrying member at an upstream side position from the first developer carrying member and in a direction in which the toner carrying member conveys the toner; and a controller which is adapted to cause a collecting operation to be executed in which reverse polarity particles remaining in a region surrounded by the toner carrying member, the first developer carrying member and the second developer carrying member are conveyed to the developer container at a timing at which development of the electrostatic latent image is not affected by the collecting operation.

According to another aspect of the present invention, another embodiment is an image forming apparatus, comprising:

an image carrying member which is adapted to carry an electrostatic latent image;

a developer container which is adapted to contain a developer including a toner, a carrier for charging the toner, and reverse polarity particles to be charged reverse to a charge polarity of the toner;

a toner carrying member which is adapted to convey a toner to a development position at which the toner carrying member faces the image carrying member to develop the electrostatic latent image on the image carrying member;

a first developer carrying member which is adapted to carry the developer supplied from the developer container and is disposed facing the toner carrying member to supply a toner to the toner carrying member;

a second developer carrying member which is adapted to carry a developer and is disposed, to collect the toner on the toner carrying member, facing the toner carrying member at an upstream side position from the first developer carrying member and in a direction in which the toner carrying member conveys the toner;

a reverse polarity particle collecting member which is provided at an upstream side, from the toner carrying member, in a direction in which the first developer carrying member conveys the developer; and a controller which is adapted to set, in a case of developing the electrostatic latent image, an electric field between the first developer carrying member and the reverse polarity particle collecting member in a direction wherein the electric field causes the reverse polarity particles to move from the first developer carrying member onto the reverse polarity particle collecting member, and to set, at a timing at which development of the electrostatic latent image is not affected, the electric field in a direction wherein the electric field causes the reverse polarity particles to move from the reverse polarity particle collecting member onto the first developer carrying member.

According to another aspect of the present invention, another embodiment is an image forming apparatus, comprising:

an image carrying member which is adapted to carry an electrostatic latent image;

a developer container which is adapted to contain a developer including a toner, a carrier for charging the toner, and reverse polarity particles to be charged reverse to a charge polarity of the toner;

a toner carrying member which is adapted to convey a toner to a development position at which the toner carrying member faces the image carrying member to develop the electrostatic latent image on the image carrying member;

a first developer carrying member which is adapted to carry the developer supplied from the developer container and is disposed facing the toner carrying member to supply a toner to the toner carrying member;

a second developer carrying member which is adapted to carry a developer and is disposed, to collect the toner on the toner carrying member, facing the toner carrying member at an upstream side position from the first developer carrying member and in a direction in which the toner carrying member conveys the toner; and a controller which is adapted to set, in a case of developing the electrostatic latent image, an electric field between the toner carrying member and the second developer carrying member such that the electric field causes the toner to move from the toner carrying member onto the second developer carrying member, and set, in a case of executing a collecting operation for collecting reverse polarity particles, the electric field between the toner carrying member and the second developer carrying member such that the electric field causes the reveres polarity particles to move from the toner carrying member onto the second developer carrying member at a timing at which the developing of the electrostatic latent image is not affected by the collecting operation.

DETAILED DESCRIPTION OF THE PREFERRED EMBODIMENT

The following describes the embodiments according to the present invention with reference to drawings.

First Embodiment

Figure 1:
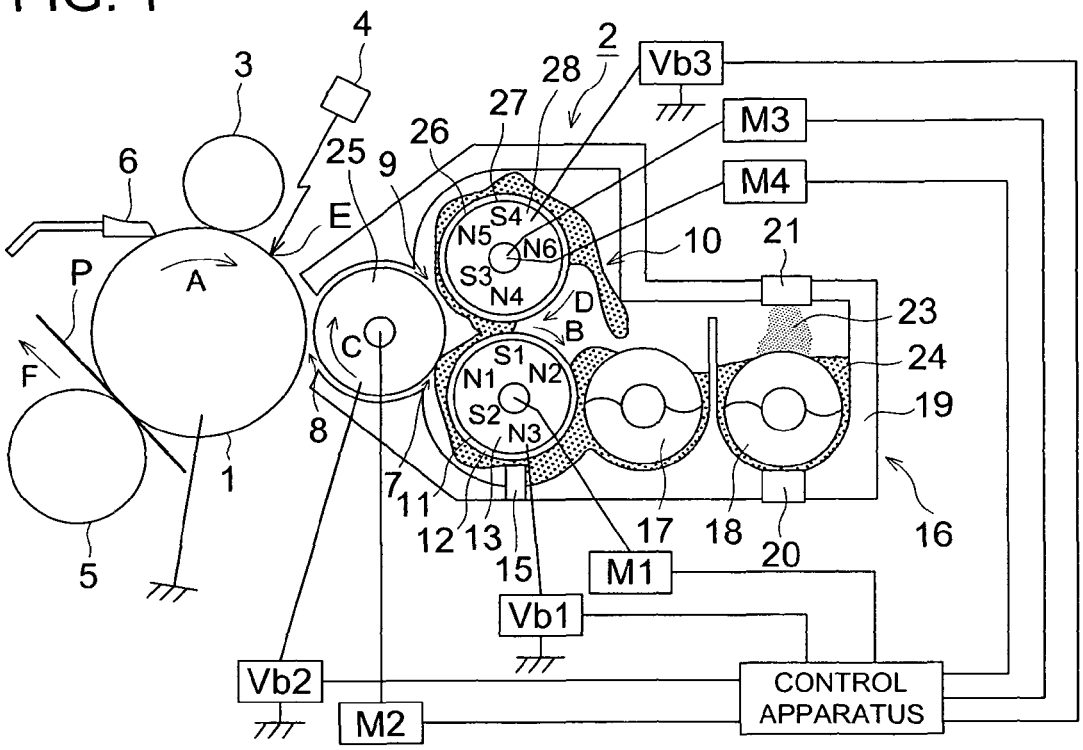
FIG. 1 is a schematic configuration diagram showing the major components of an image forming apparatus and a developing device as a first embodiment according to the present invention.

FIG. 1 shows the major components of an image forming apparatus as a first embodiment of the present invention. The image forming apparatus is a printer wherein the toner image, formed by electro-photographic technology, on an image carrying member (photoreceptor) 1 is transferred onto a transfer medium P such as paper, whereby an image is formed. This image forming apparatus has the image carrying member 1 for carrying an image. Around the image carrying member 1, a charging device 3 for charging the image carrying member 1, an exposure device 4 for exposing the image carrying member 1 to form an electrostatic latent image, a developing device 2 for developing the electrostatic latent image on the image carrying member, a transfer roller 5 for transferring a toner image on the image carrying member 1, and a cleaning blade 6 for removing residual remaining on the image carrying member 1 are arranged sequentially in this order in the rotating direction A of the image carrying member 1.

After having been charged by the charging device 3, the image carrying member 1 is exposed to light at point E of FIG. 1 by an exposure device 4 provided with a laser light emitting device, and an electrostatic latent image is formed on the surface thereof. The developing device 2 develops this electrostatic latent image into a toner image. The transfer roller 5 transfers the toner image on the image carrying member 1 onto the transfer medium P, which is then ejected in the direction of arrow F. After the transfer, the cleaning blade 6 removes the toner remaining on the image carrying member 1 by a mechanical force. Any technique of the conventionally known electro-photographic technology can be used for the image carrying member 1, charging device 3, exposure device 4, transfer roller 5, cleaning blade 6 and other devices used in the image forming apparatus. Instead of the charging roller, a charging device not in contact with the image carrying member 1 can be used, for example. The cleaning blade, for example, can be omitted.

In the present embodiment, the developing device 2 includes a developer container 16 for storing a developer 24; a first developer carrying member 11 for toner supply that conveys the developer 24 supplied from the developer container 16 with the developer kept on the surface; a toner carrying member 25 that receives toner from the first developer carrying member 11 in the toner supply area 7 and develops the electrostatic latent image formed on a image carrying member 1; and a second developer carrying member 26 for toner collection that collects the toner, not having been used and having passed through the development area 8, remaining on the toner carrying member 25, wherein this toner is collected in a toner collection area 9. The developer 24 contains toner, carriers for charging the toner, and reverse polarity particles having a charging property reverse to that of the toner. By forming an electric field, which supplies a toner and collect reverse polarity particles, in the toner supply area 7 when the first developer carrying member 11 supplies the toner to the toner carrying member 25, the reverse polarity particles which are conveyed to the development area 8 can be reduced. Reduction of the consumption of the reverse polarity particles by this arrangement and collection of the reverse polarity particles into the developer container 16 can help the reverse polarity particles to effectively assist the carrier to charge, and thus, the deterioration in the amount of charge to be charged to toner can be suppressed over a long period of time.

The reverse polarity particles are charged to have a polarity reverse to that of the toner by the carrier and/or toner in the developer. When using the toner to be charged negative by the carrier, the reverse polarity particles are positively charged in the developer. When using the toner to be charged positive by the carrier, the reverse polarity particles are negative charge particles which are negatively charged in the developer. The two-component developer is impregnated with reverse polarity particles, and the reverse polarity particles are accumulated in the developer. This procedure ensures that, even if the charging property of the carrier has been reduced by spent of toner or the finishing agent added to the carrier, the shortage of charging property of the carrier is compensated since reverse polarity particles are also capable of charging the toner to have the regular polarity, with the result that reduction in the charging property of toner can be suppressed.

Preferable reverse polarity particles are appropriately selected according to the charging polarity of toner. When negatively charged toner is used, positive charge particles are used as the reverse polarity particles. For example, it is possible to use inorganic particles such as strontium titanate, barium titanate, calcium titanate and alumina, or the particles made of thermoplastic or thermosetting resin such as acryl resin, benzoguanamine resin, nylon resin, polyimide resin and polyamide resin. Further, the resin can be impregnated with the positive charge regulating agent that applies positive charging property, or a copolymer of nitrogen-containing monomer can be formed. In this case, nigrosine dye, quarternary ammonium salt and others can be used as the aforementioned positive charge regulating agent. Further, 2-dimethylaminoethyl acrylate, 2-diethylaminoethyl acrylate, 2-dimethylaminoethyl methacrylate, 2-diethylaminoethyl methacrylate, vinyl pyridine, N-vinyl carbazole, vinyl imidazole and others can be used as the aforementioned nitrogen-containing monomer.

When positive charge toner is used, particles having negative charging properties are used as the reverse polarity particles. For example, it is possible to use the particles made up of a thermoplastic resin or thermosetting resin such as fluorine resin, polyolefin resin, silicone resin, polyester resin or the like, in addition to the inorganic particles of silica, titanium oxide or the like. Further, the resin can be impregnated with the negative charge regulating agent for applying negative charging property, or a copolymer of fluorine-containing acryl based monomer or fluorine-containing methacryl based monomer can be formed. In this case, chromium complex of salicylic acid or naphthol, aluminum complex, iron complex, zinc complex and others can be used as the aforementioned negative charge regulating agent.

Further, to regulate the charging property and hydrophobic property of reverse polarity particles, the surface of the inorganic particles can be treated by silane coupling agent, titanium coupling agent, or silicone oil. Especially when the inorganic particles are positively charged, surface treatment by amino group containing coupling agent is preferred. When the particles are negatively charged, surface treatment by fluorine group containing coupling agent is preferred.

The number average particle diameter of the reverse polarity particles is preferably in the range of 100 through 1000 nm.

There is no particular restriction to toner. It is possible to use commonly known toner that is generally utilized. A coloring agent, and a charge regulating agent or a mold releasing agent, if required, can be contained in the binder resin. The toner treated with external additive agent can also be used. Although there is no particular restriction to the toner particle size, the preferred size is in the range of 3 through 15 μm.

Such toner can be produced according to the commonly known method of general use. For example, it is possible to use the pulverization method, emulsion polymerization method, suspension polymerization method and others to product such toner.

There is no restriction to the binder resin used to produce toner. The binder resin can be exemplified by styrene-based resin (single polymer or copolymer including styrene or substituted styrene), polyester resin, epoxy based resin, vinyl chloride resin, phenol resin, polyethylene resin, polypropylene resin, polyurethane resin, silicone resin and others. It is preferred to use a simple substance or complex of the aforementioned resins having a softening temperature in the range of 80 through 160° C. and a glass transition temperature in the range of 50 through 75° C.

The coloring agent can generally used and commonly known agent. It is exemplified by carbon black, aniline black, activated carbon, magnetite, benzine yellow, permanent yellow, naphthol yellow, phthalocyanine blue, fast skyblue, ultra marine blue, rose bengal, lake red and others. It is preferred to use 2 through 20 parts by mass of such a substance with respect to 100 parts by mass of the aforementioned binder resin.

A conventionally known charge regulating agent can be used as the aforementioned charge regulating agent. A nigrosine dye, quarternary ammonium salt compound, triphenyl methane compound, imidazole compound and polyamine resin can be used as a charge regulating agent for positive charge toner. Metal-containing azo dye such as Cr, Co, Al and Fe, salicylic acid metallic compound, alkyl salicylic acid metallic compound and Kerlix arene compound can be used as a charge regulating agent for negative charge toner. With respect to 100 parts by mass of the aforementioned binder resin, 0.1 through 10 parts by mass of the charge regulating agent is preferably used.

Further, a conventionally known mold releasing agent of general use can be employed as the aforementioned mold releasing agent. For example, polyethylene, polypropylene, carnauba wax or sazol wax can be used independently, or a combination of two or more of these substances can be used. With respect to 100 parts by mass of the aforementioned binder resin, 0.1 through 10 parts by mass of mold releasing agent is preferably utilized.

Further, a conventionally known external additive agent of general use can be employed as the aforementioned external additive agent. To improve fluidity, it is possible to employ inorganic particles of silica, titanium oxide, aluminum oxide and others, and resin particles of acryl resin, styrene resin, silicone resin, fluorine resin and others, for example. It is particularly preferred to use the substance having been hydrophobized by silane coupling agent, titanium coupling agent or silicone oil. With respect to 100 parts by mass of the aforementioned toner, 0.1 through 5 parts by mass of such a superplasticizer is preferably added. The number average primary particle diameter of the external additive agent is preferably in the range of 10 through 100 nm.

There is no particular restriction to the carrier. It is possible to use commonly known carrier that is generally utilized. A binder type carrier and coated type carrier can be employed. There is no particular restriction to the carrier particle diameter. The preferred size is in the range of 15 through 100 μm.

The binder type carrier is made up of magnetic particles dispersed in the binder resin. Chargeable fine particles having positive or negative charging property can be bonded to the carrier surface, or a surface coated layer can be provided. The charging property such as a charging polarity of the binder type carrier can be controlled by the material of the binder resin, and the type of the chargeable fine particles or surface-coating layer.

The binder resin used in the binder type carrier can be exemplified by thermoplastic resins such as vinyl resin, polyester resin, nylon resin and polyolefin resin represented by polystyrene resin; and thermosetting resins such as phenol.

The spinel ferrite such as magnetite or gamma iron oxide, the spinel ferrite containing one or more types of metals (Mn, Ni, Mg, Cu and others) other than iron, the magnetoplumbite-type ferrite such as barium ferrite, or the iron or alloy particles containing an oxide layer on the surface can be used as the magnetic particles of the binder type carrier. These particles can be granular, globular or acicular. When magnetization to a particularly high level is required, iron-based ferromagnetic particles are preferably used. When consideration is given to chemical stability, it is preferred to use ferromagnetic particles made of spinel ferrite including magnetite or gamma iron oxide or magnetoplumbite-type ferrite such as barium ferrite. Magnetic resin carrier having a desired level of magnetism is provided by appropriate selection of the type and content of the ferromagnetic particles. To the magnetic resin carrier, 50 through 90% by mass of magnetic particles is preferably added.

Silicone resin, acryl resin, epoxy resin and fluorine resin can be used as the surface-coating agent for the binder type carrier. These resins are coated on the surface to form a coated layer, whereby the charge applying performance can be enhanced.

The chargeable fine particles or conductive fine particles are bonded on the surface of the binder type carrier as follows: For example, magnetic resin carrier and fine particles are mixed uniformly, and these fine particles are bonded on the surface of the magnetic resin carrier. After that, mechanical and thermal impact is applied, and fine particles are driven into the magnetic resin carrier, whereby fine particles are bonded on the surface. In this case, fine particles are not completely buried in the magnetic resin carrier. The fine particles are bonded on the surface in such a way that a part of each fine particle is protruded from the magnetic resin carrier surface. Organic or inorganic insulating materials are used as the chargeable Fine particles. To put it more specifically, organic examples includes organic insulating fine particles such as polystyrene, styrene-based copolymer, acryl resin, various types of acryl copolymer, nylon, polyethylene, polypropylene, fluorine resin and the crosslinked substances thereof. A desired level of charge and polarity can be obtained by proper selection of the material, polymerization catalyst and surface treatment. Inorganic examples include the negatively charged inorganic particles such as silica and titanium dioxide, and positively charged inorganic particles such as strontium titanate and alumina.

The coating type carrier is made up of the carrier core particles made of magnetic substance, provided with resin coating. Positive or negative charge particles can be bonded on the carrier surface of the coated carrier, similarly to the case of binder type carrier. The charging property such as the polarity of the coated carrier can be controlled by proper selection of the type of the surface-coating layer and chargeable fine particles. The same material as that of the binder type carrier can be utilized. The same resin as the binder resin of the binder type carrier can be used especially as a coating resin.

The mixture ratio of toner and carrier can be adjusted so as to get a desired amount of toner charge. With respect to the total of the toner and carrier, 3 through 50% by mass, preferably 6 through 30% by mass of toner is used.

Although there is no particular restriction to the amount of reverse polarity particles contained in the developer, 0.01 through 5.00 parts by mass, particularly 0.01 through 2.00 parts by mass of reverse polarity particles is preferably used with respect to 100 parts by mass of carrier.

The developer can be prepared, for example, by externally adding the reverse polarity particles to the toner in advance, and then mixing them with the carrier.

As shown in FIG. 1, the first developer carrying member 11 is connected with a power source Vb1, and the toner carrying member 25 is connected with a power source Vb2. During the image-forming period, the toner in the developer in the supply area 7 is supplied to the toner carrying member 25 by the electric field formed by the power source Vb1 and power source Vb2. The reverse polarity particles are collected into the first developer carrying member 11. In the development area 8, the electrostatic latent image on the grounded image carrying member 1 is developed by the electric field formed by the development bias caused by the power source Vb2 with the toner on the toner carrying member 25. Further, the second developer carrying member 26 is connected with the power source Vb3. During the image-forming period, in the toner collection area 9, the post-development toner on the toner carrying member 25 is collected by the electric field between the toner carrying member 25 and the second developer carrying member 26.

The development bias applied to the toner carrying member 25 differs according to the charging polarity of the toner. To be more specific, when the negative charge toner is used, the voltage should have an average value which is higher than the average value of the voltages applied to the first developer carrying member 11. When the positively charged toner is used, the voltage should have an average value which is lower than the average value of the voltages applied to the first developer carrying member 11. Independently of whether the toner is negatively charged or positively charged, the difference between the average voltage applied to the toner carrying member 25 and the average voltage applied to the developer carrying member is preferably in the range of 20 through 500V, particularly 50 through 300V. If the voltage difference is too small, a sufficient amount of toner cannot be supplied onto the toner carrying member 25, and sufficient image density thus cannot be obtained. If the voltage difference is too large, too much amount of toner is supplied, and a greater amount of toner thus may be consumed in vine.

The electric field (toner-supplying electric field) formed between the toner carrying member 25 and the first developer carrying member 11 is preferably AC electric field. The AC toner-supplying electric field is formed by applying an AC voltage to the toner carrying member 25 and/or the first developer carrying member 11. When the AC voltage is applied to the toner carrying member 25 to develop the electrostatic latent image by toner, the AC toner-supplying electric field is formed using the AC voltage applied to the toner carrying member 25. The formed AC electric field reciprocatingly vibrates the toner, whereby the toner and reverse polarity particles can be separated effectively. In this case, the electric field of $2.5\times10^6$V/m or more without exceeding $5\times10^6$V/m is preferably formed. When the electric field of $2.5\times10^6$V/m or more has been formed, the reverse polarity particles can be separated from the toner by the electric field, whereby the separability between the toner and reverse polarity particles can be enhanced. Further, when the electric field exceeds $5\times10^6$V/m, an electrical discharge tends to be generated easily between the toner carrying member 25 and the first developer carrying member 11, and this is not preferred.

When the toner is positively charged, and the DC voltage and AC voltage are applied to the first developer carrying member 11 and only the DC voltage is applied to the toner carrying member 25, the DC voltage lower than the average value of the voltages (DC+AC) applied to the first developer carrying member 11 is applied to the toner carrying member 25. Alternatively, when the toner is negatively charged, the DC voltage and AC voltage are applied to the first developer carrying member 11, only the DC voltage is applied to the toner carrying member 25, and only the DC voltage higher than the average value of the voltages (DC+AC) applied to the first developer carrying member is applied to the toner carrying member 25. In these cases, the maximum value of the absolute value of the toner-supplying electric field is the value obtained by dividing the maximum value of the potential differences between the voltage (DC+AC) applied to the first developer carrying member 11 and voltage (DC) applied to the toner carrying member 25, by the gap at the closest portion between the toner carrying member 25 and the first developer carrying member 11. This value is preferably kept within the aforementioned range.

When the toner is positively charged, and only the DC voltage is applied to the first developer carrying member 11, and the AC voltage and DC voltage are applied to the toner carrying member 25, the toner carrying member 25 is applied with the DC voltage with the AC voltage superimposed thereon so that the average voltage on the toner carrying member is lower than the DC voltage applied to the first developer carrying member 11. Alternatively, when the toner is negatively charged, and only the DC voltage is applied to the first developer carrying member 11, and the AC voltage and DC voltage are applied to the toner carrying member 25, the toner carrying member 25 is applied with the DC voltage with the AC voltage superimposed thereon so that the average voltage on the toner carrying member is higher than the DC voltage applied to the first developer carrying member 11. In these cases, the maximum value of the absolute value of the toner-supplying electric field is the value obtained by dividing the maximum value of the potential differences between the voltage (DC) applied to the first developer carrying member 11 and voltage (DC+AC) applied to the toner carrying member 25, by the gap at the closest portion between the toner carrying member 25 and the first developer carrying member 11. This value is preferably kept within the aforementioned range.

When the toner is positively charged, and the DC voltage with AC voltage superimposed thereon is applied to both the first developer carrying member 11 and toner carrying member 25, the toner carrying member 25 is applied with the voltage (DC+AC) wherein the average voltage is lower than the average value of the voltages (DC+AC) applied to the first developer carrying member 11. Alternatively, when the toner is negatively charged, and the DC voltage with AC voltage superimposed thereon is applied to both the first developer carrying member 11 and toner carrying member 25, the toner carrying member 25 is applied with the voltage (DC+AC) wherein the average voltage is higher than the average value of the voltages (DC+AC) applied to the first developer carrying member 11. In such cases, the maximum value of the absolute value of the toner-supplying electric field is the value obtained by dividing the maximum value in the potential difference, caused by the differences in the amplitude, phase, frequency and duty ratio of the AC voltage component applied thereto, between the voltage (DC+AC) applied to the first developer carrying member 11 and the voltage (DC+AC) applied to the toner carrying member 25 by the gap at the closest portion between the toner carrying member 25 and the first developer carrying member 11. This value is preferably kept within the aforementioned range.

The developer container 16 is formed of a casing 19 and incorporates mixing and stirring members 17 and 18 that mix and stir the developer and supply it to the first developer carrying member 11. An ATDC (Automatic Toner Density Control) sensor 20 for detecting toner density is installed at a position opposite to the mixing and stirring member 18 in the casing 19.

The developing device 2 has a replenishing section 21 for replenishing the developer container 16 with the toner to be consumed in the development area 8. In the replenishing section 21, the replenishing-toner 23 from a hopper (not illustrated) storing the replenishing-toner 23 is fed into the developer container 16.

The toner with reverse polarity particles externally added thereto is preferably used as the replenishing-toner 23. Use of the toner with the reverse polarity particles externally added thereto effectively compensates the reduction in the charging property of the carrier which is subjected to gradual deterioration due to long-term use. The amount of the reverse polarity particles to be externally added to the replenishing-toner 23 is preferably in the range of 0.1 through 10.0% by mass, more preferably in the range of 0.5 through 5.0% by mass.

The developing device 2 has a regulating member 15 for reducing the thickness of developer layer for the purpose of regulating the amount of developer on the first developer carrying member 11. The first developer carrying member 11 is made up of a magnetic roller 13 fixed in position, and a freely rotatable sleeve roller 12 containing the magnetic roller 13 therein. The toner-supplying bias for supplying toner to the toner carrying member 25 is applied thereto from the power source Vb1. The magnetic roller 13 has five magnetic poles N1, S1, N2, N3, and S2 installed in the rotating direction B of the sleeve roller 12. Of these magnetic poles, the major magnetic pole N1 is arranged in the toner supply area 7 opposite to the toner carrying member 25. Similarly, the second developer carrying member 26 is made up of a magnetic roller 28 (designed to be rotatable by a predetermined angle) and a freely rotatable sleeve roller 27 containing the magnetic roller 28 therein. The collection bias for collecting toner remaining on the post-development toner carrying member 25 is applied from the power source Vb3. The magnetic roller 28 has five magnetic poles N4, S3, N5, S4 and N6 installed in the rotating direction C of the sleeve roller 27. Of these magnetic poles, the major magnetic pole S3 is arranged in the toner collection area 9 opposite to the toner carrying member 25. The homopolar sections N6 and N4 which generate the repulsive magnetic field for separating the developer 24 from the sleeve roller 27 are arranged at the position facing the inside of the developer container 16. Further, in order to feed the developer on the first developer carrying member 11 to the second developer carrying member 26, the magnetic poles S1 and N4 are installed at the position where the first developer carrying member 11 and the second developer carrying member 26 face each other. The toner carrying member 25 are arranged to be opposite to each of the first developer carrying member 11, the second developer carrying member 26 and the image carrying member 1. Development bias for developing the electrostatic latent image on the image carrying member is applied from the power source Vb2. In FIG. 1, M1, M2, M3 and M4 denote the drive sections of the first developer carrying member 11, toner carrying member 25 (sleeve roller 12), the second developer carrying member 26 (sleeve roller 27) and magnetic roller 28, respectively. These drive sections can be separate motors, or can be structured in such a way that the driving force is transmitted from a common motor by a transmission mechanism. In case that there is no rotation of the magnetic roller 28 (to be described later), the drive section M4 need not be installed. Further, the drive section and power source is connected with a controller that controls them.

There is no restriction to the material of the toner carrying member 25 if voltage can be applied. For example, an aluminum roller provided with surface treatment can be employed. Further, there can be used the conductive substrate of aluminum and others coated with resin such as a polyester resin, polycarbonate resin, acryl resin, polyethylene resin, polypropylene resin, urethane resin, polyamide resin, polyimide resin, polysulfone resin, polyether ketone resin, vinyl chloride resin, vinyl acetate resin, silicone resin, and fluorine resin. Alternatively, there can be used the conductive substrate of aluminum and others coated with rubber such as silicone rubber, urethane rubber, nitrile rubber, natural rubber, and isoprene rubber. There is no restriction to the coating agent. A conductive agent can be added to the bulk or surface treated with the aforementioned coating. The conductive agent is exemplified by an electron conductive agent and ion conductive agent. The electron conductive agent includes the examples of carbon black such as ketchin black, acetylene black and furnace black, and fine particles such as metal powder and metal oxide fine particles, without the present invention being restricted thereto. The ion conductive agent includes the examples of a cationic compound such as quarternary ammonium salt, amphoteric compound and other ionic polymeric materials, without the present invention being restricted thereto. Further, it is also possible to use a conductive roller made of metal material such as aluminum.

The following describes the details of the operation of the developing device 2 of FIG. 1.

The developer 24 in the developer container 16 is mixed and stirred by the mixing and stirring members 17 and 18, and is subjected to triboelectric charging. At the same time, the developer 24 is circulated inside the developer container 16, and is fed to the sleeve roller 12 on the surface of the first developer carrying member 11. By the magnetic force of the magnetic roller 13 inside the first developer carrying member 11, this developer 24 is held on the surface of the sleeve roller 12. The developer is rotated and moved together with the sleeve roller 12, and the amount of the developer allowed to pass by is regulated by the regulating member 15 installed facing the first developer carrying member 11. After that, the developer is fed to the toner supply area 7 located facing the toner carrying member 25.

In the toner supply area 7, a bristle of developer is made by the magnetic force of the main magnetic pole N1 of the magnetic roller 13, and toner in the developer is supplied onto the toner carrying member 25 by the force given to the toner by the toner-supplying electric field formed by the development bias applied to the toner carrying member 25 and the toner-supplying bias applied to the first developer carrying member 11. At the same time, the reverse polarity particles are collected into the developer on the first developer carrying member 11.

The toner supplied to the toner carrying member 25 is fed to the development area 8 by the rotation of the toner carrying member 25, and the electrostatic latent image is developed into a visible image by the electric field formed by the development bias and the latent image potential on the image carrying member 1. Either regular or reversal development method can be used for this development. After toner has been consumed in the development area 8, toner remaining on the toner carrying member 25 after development is fed to the toner collection area 9 opposite to the second developer carrying member 26.

In the meantime, the developer from which toner has been supplied to the toner carrying member 25 in the toner supply area 7 and which has collected the reverse polarity particles is conveyed to the position opposite to the second developer carrying member 26, and is then fed onto the second developer carrying member 26 by the magnetic field formed by the magnetic pole S1 of the first developer carrying member 11 and the magnetic pole N4 of the second developer carrying member 26.

The developer having been fed to the second developer carrying member 26 is rotated and moved together with the sleeve roller 27 of the second developer carrying member 26 and is conveyed to the toner collection area 9 opposite to the toner carrying member 25.

In the toner collection area 9, the toner remaining on the post-development toner carrying member 25 is collected from the toner carrying member 25 onto the second developer carrying member 26 by the electrostatic force generated by the electric field formed by the development bias applied to the toner carrying member 25 and toner collection bias applied to the second developer carrying member 26, and by the mechanical sliding force of the developer with a bristle made by the magnetic force of the main magnetic pole S3 of the second developer carrying member 26. At this time, the reverse polarity particles in the developer on the second developer carrying member 26 is applied with the electrostatic force in the direction opposite to that applied to the toner. Thus, the reverse polarity particles move to the toner carrying member 25. The developer including the toner collected onto the second developer carrying member 26 is fed toward the developer container 16, and is separated from the second developer carrying member 26 by the repulsive magnetic field of the homopolar magnetizing sections N6 and N4 of the magnetic roller 28 so as to be collected into the developer container 16. When a toner replenishment controller has detected from the output value of the ATDC sensor 20 that the toner density of the developer 24 has been reduced below the minimum toner density for ensuring an image density, the toner replenishment controller replenishes the developer container 16 with the replenishing-toner 23 stored in the hopper, through a toner replenishing section 21.

In FIG. 1, the first developer carrying member 11 and the second developer carrying member 26 are installed opposite to each other, and the developer supplied from the developer container 16 onto the first developer carrying member 11 is regulated on the first developer carrying member 11. The developer is fed from the first developer carrying member 11 to the second developer carrying member 26, and is separated from the second developer carrying member 26 to go back to the developer container 16. However, the flow of developer is not restricted to this example. For example, after the developer has been fed from the second developer carrying member 26 again to the first developer carrying member 11, the developer can be separated from the first developer carrying member 11 to go back to the developer container 16.

Figure 2:
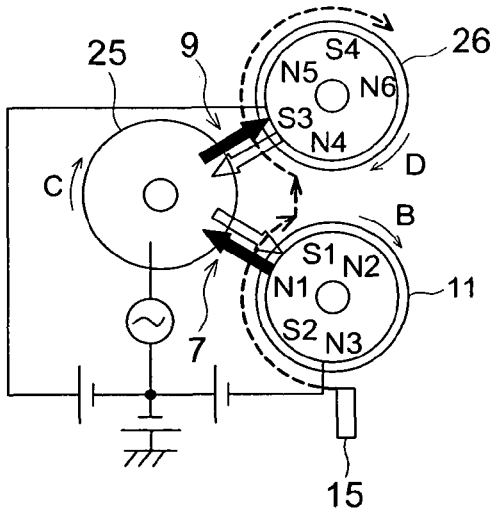
FIG. 2 is a schematic diagram showing the accumulation of reverse polarity particles.

Referring to FIG. 2, the following describes the accumulation of reverse polarity particles using an example of negative charge toner: As shown in FIG. 2, in the hybrid development method with separated toner supply/collection function type using the first developer carrying member 11 and the second developer carrying member 26, the first developer carrying member 11 is applied with the DC voltage lower than the average value of the voltage applied to the toner carrying member 25 for the purpose of supplying the toner carrying member 25 with toner. The second developer carrying member 26 is applied with the DC voltage higher than the average value of the voltage applied to the toner carrying member 25 for the purpose of collecting the post-development toner remaining on the toner carrying member 25.

The developer regulated by the regulating member 15 is fed to the toner supply area 7 by the rotation of the first developer carrying member 11, and toner is supplied onto the toner carrying member 25 because the electrostatic force in the direction of black arrow in the drawing is applied to the negative charge toner in the developer by the electric field formed in the toner supply area 7. The toner supplied to the toner carrying member 25 is conveyed by the rotation of the toner carrying member 25 and is fed to the toner collection area 9 after passing through the development area 8.

In the meantime, the developer from which the toner has been supplied is conveyed to the area opposite to the second developer carrying member 26 by the rotation of the first developer carrying member 11, and is then fed onto the second developer carrying member 26 by the magnetic force of the S1 and N4. The developer is then fed to the toner collection area 9 by the rotation of the second developer carrying member 26 (the arrow of dotted line indicating the flow of the developer).

In the toner collection area 9, an electric field reverse to that in the toner supply area 7 is formed. Thus, the post-development toner remaining on the toner carrying member 25 receives the electrostatic force in the direction of black arrow, and is collected into the developer on the second developer carrying member 26. The toner together with the developer is collected into the developer container 16. Thus, in the toner collection area 9, the toner layer subjected to the development hysteresis on the toner carrying member 25 is reset. This arrangement provides a high-quality image free from development hysteresis (image memory).

However, the reverse polarity particles in the developer are charged to have a polarity (positive charge in this case) reverse to that of the charged toner. Accordingly, in the toner supply area 7 and toner collection area 9, the particles receive electrostatic force in the direction (white open arrow in the drawing) reverse to that of toner. The electric field that moves the reverse polarity particles from the toner carrying member 25 to the first developer carrying member 11 works in the toner supply area 7. Accordingly, simultaneously with the supply of toner, reverse polarity particles deposited on the toner and toner carrying member 25 are collected into the developer. In the toner supply area 7, the reverse polarity particles collected in the developer are conveyed to the toner collection area 9 by the flow of the developer. In the toner collection area 9, the electrostatic force is conversely applied in the direction in which the reverse polarity particles are supplied to the toner carrying member 25, and therefore, the particles are supplied to the toner carrying member 25, and are again conveyed to the toner supply area 7 by the rotation of the toner carrying member 25.

Thus, the reverse polarity particles circulate (accumulate) within the area surrounded by the toner carrying member 25, the first developer carrying member 11, the second developer carrying member 26. If the accumulation of the reverse polarity particles is left as it is, the reverse polarity particles cannot be collected sufficiently into the developer container 16. This will cause a reduction in the effect of assisting the charging property of the carrier.

Thus, if the closed loop circulation (accumulation) of the reverse polarity particles is cut off and the reverse polarity particles having been accumulated are collected into the developer container 16, this procedure realizes the effect of assisting the charging property of the carrier by using the reverse polarity particles, and ensures a stable supply of high-quality images almost without occurrence of development hysteresis (image memory), over a long period of time.

Thus, using the time interval in which the development of the latent image on the image carrying member 1 is not affected, i.e., non-image-forming period that does not affect the operation of image formation, control is provided in such a way as to cut off the closed loop circulation (accumulation) of the reverse polarity particles within the area enclosed by the toner carrying member 25, first developer carrying member 11, and second developer carrying member 26 (hereinafter referred to as "accumulation release operation).

Figure 3A:
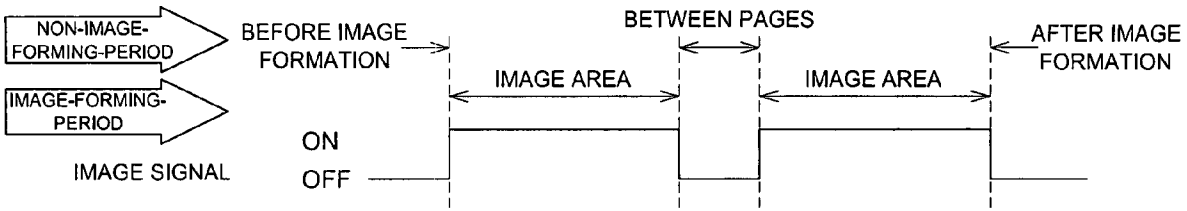
FIGS. 3*a* and 3*b* are schematic diagrams showing the timing of an image forming operation.
Figure 3B:
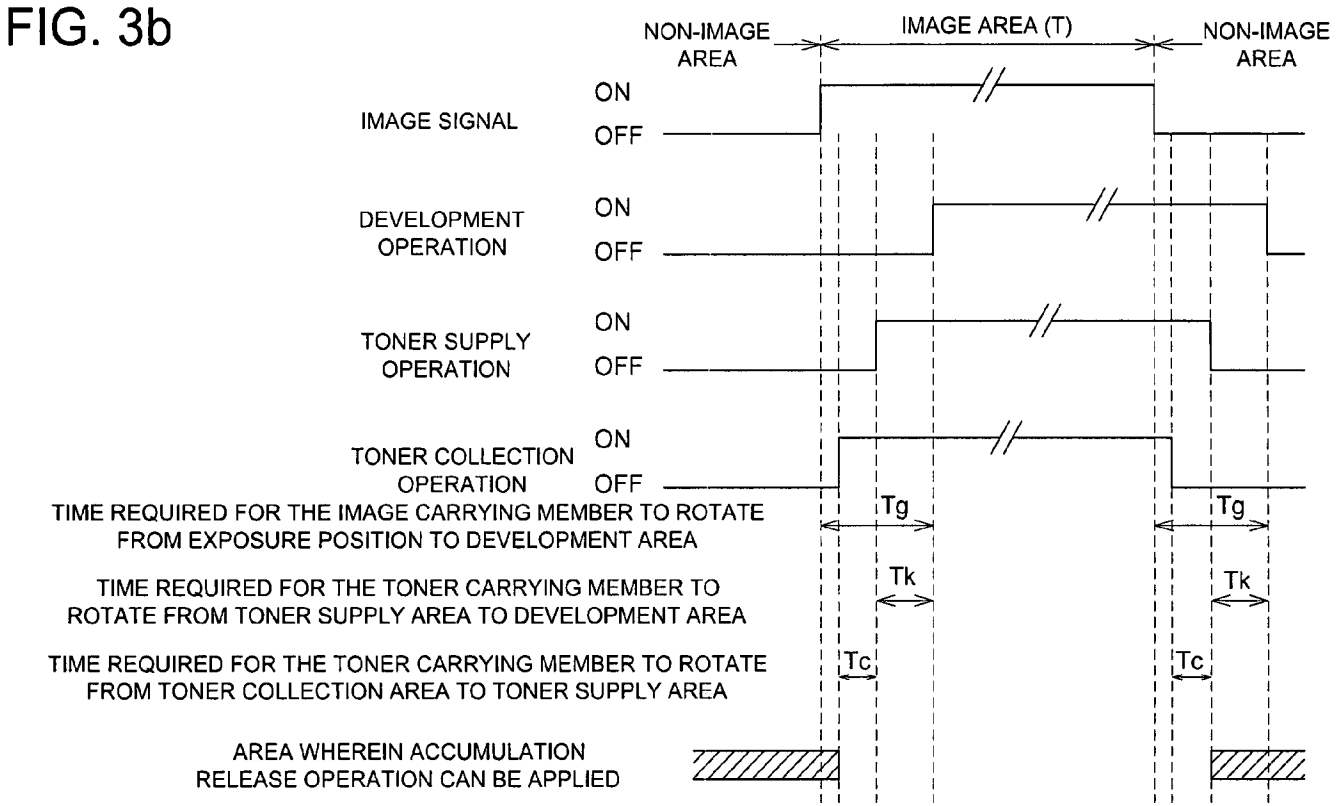

As shown in FIG. 3*a*, the non-image-forming period can be defined as the interval before and after image formation or the interval between pages (also called the interval between images, or interval between sheets of paper). For more detailed description, FIG. 3*b* is an enlarged view showing the time scale at the time of switching between the image area and non-image area of FIG. 3*a*.

The timing at which an image is started to be formed on the image carrying member 1 is when an image is started to be exposed on the image carrying member 1 by the exposure device 4 in the exposure position E to form an electrostatic latent image. The time interval from the start of exposure to the termination of the exposure is shown as the image area (T).

Development of the electrostatic latent image on the image carrying member 1 by toner on the toner carrying member 25 starts later, than the time when the image signal is turned on, by the time period (Tg) required for the electrostatic latent image formed at the position of exposure to rotate to the development area 8.

The toner used in this development is supplied from the first developer carrying member 11 to the toner carrying member 25 earlier, than the start of development, by the time period (Tk) required for the toner carrying member 25 to rotate from the toner supply area 7 to the development area 8.

Collection of toner by the second developer carrying member 26 is carried out earlier, than the supply of toner, by the time period (Tc) required for the toner carrying member 25 to rotate from the toner collection area 9 to the toner supply area 7. This is intended to solve the problem of development hysteresis on the toner carrying member 25 prior to the supply of toner, because the first developer carrying member 11 supplies toner to the toner carrying member 25 free of development hysteresis.

The termination timing of each of these operations is delayed from each startup time by the time period equal to the image area (T).

Thus, the time interval available for permitting release of the accumulation to be conducted during the non-image-forming period without affecting the development of a latent image denotes the time interval between the termination of the supply of the toner for one image and the start of collection of the toner for the next image, as shown by the hatched area of FIG. 3*b*, when the aforementioned time difference is taken into account. There is no particular restriction to time intervals wherein the accumulation release operation is executed. This operation can be applied to every sheet to be printed, or every predetermined number of sheets to be printed. Thus, accumulation release operation can be performed as appropriate. For example, if the number of prints for one job does not exceed a predetermined number, the accumulation release operation may be performed at the termination of the job. If the number of prints for one job is not less than a predetermined number, the accumulation release operation may be performed every predetermined number of sheets.

The following describes the details of the accumulation release operation:

If the developer containing an increased amount of reverse polarity particles is returned directly into the developer container 16, it makes it possible that the developer containing an increased amount of reverse polarity particles in the area enclosed by the toner carrying member 25, the first developer carrying member 11 and the second developer carrying member 26 is collected into the developer container 16. To be more specific, without being fed to the second developer carrying member 26, the developer on the first developer carrying member 11 can be conveyed to the developer container 16 by the first developer carrying member 11, and is separated from the first developer carrying member 11 by the repulsive field of the homopolar sections N2 and N3 of the magnetic roller 13. Then the developer is collected into the developer container 16. In this case, the gap between the first developer carrying member 11 and the second developer carrying member 26 is preferably greater than the gap between the first developer carrying member 11 and the regulating member 15 in order to allow the developer on the first developer carrying member 11 to pass through the gap.

To allow passage of the developer between the first developer carrying member 11 and the second developer carrying member 26 while the developer on the first developer carrying member 11 is kept on the first developer carrying member 11, the ability of the first developer carrying member 11 to convey the developer should be made greater than the ability of the second developer carrying member 26 to convey the developer.

Figure 4A:
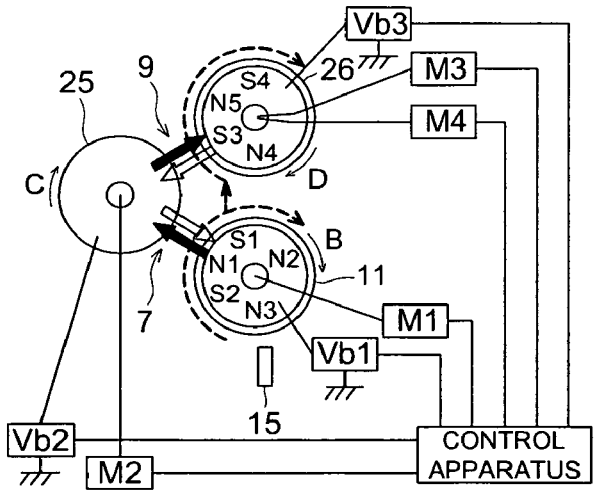
FIGS. 4*a*, 4*b* and 4*c* are schematic diagrams showing an example of removing the accumulation of reverse polarity particles.

To put it more specifically, as shown in FIG. 4*a*, the second developer carrying member drive section M3 is controlled by the controller so that the speed of the second developer carrying member 26 is lower than that of the first developer carrying member 11, whereby part of the developer having been conveyed to the first developer carrying member 11 can be fed directly from the first developer carrying member 11 to the developer container 16, without being fed to the second developer carrying member 26. This arrangement ensures that, in the area enclosed by the toner carrying member 25, the first developer carrying member 11 and the second developer carrying member 26, the developer containing an increased amount of reverse polarity particles is gradually collected into the developer container 16, whereby the accumulation of the reverse polarity particles is released.

Figure 4B:
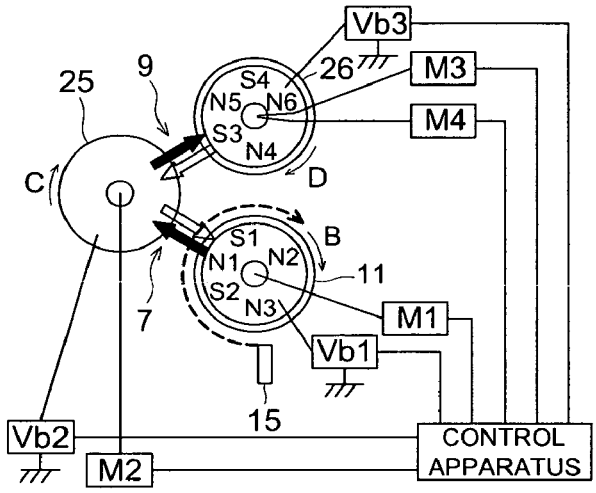

As shown in FIG. 4*b*, according to another way of releasing the accumulation of the reverse polarity particles, the second developer carrying member drive section M3 is controlled by the controller so that the second developer carrying member 26 is stopped, whereby the ability of the second developer carrying member 26 to convey the developer is reduced to zero (i.e., the amount of developer to be newly conveyed is reduced to zero). Thus, the amount of reverse polarity particles increased by the first developer carrying member 11 can be quickly collected into the developer container 16.

Figure 4C:
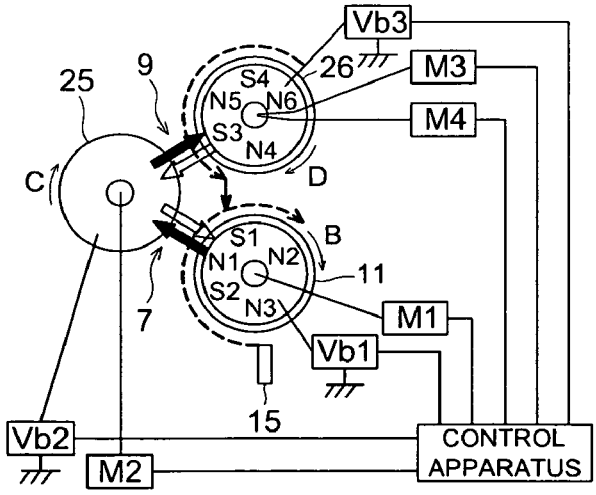

According to another method, as shown in FIG. 4*c*, the second developer carrying member drive section M3 is controlled in such a way as to reverse the direction of the second developer carrying member 26 carrying the developer. Thus, in the area enclosed by the toner carrying member 25, the first developer carrying member 11, and the second developer carrying member 26, the developer containing an increased amount of reverse polarity particles is returned to the developer container 16, whereby the accumulation of the reverse polarity particles can be released.

In this case, the developer on the second developer carrying member 26 can be returned to the developer container 16 through the first developer carrying member 11. This arrangement ensures more effective release of accumulation of the reverse polarity particles.

Figure 5:
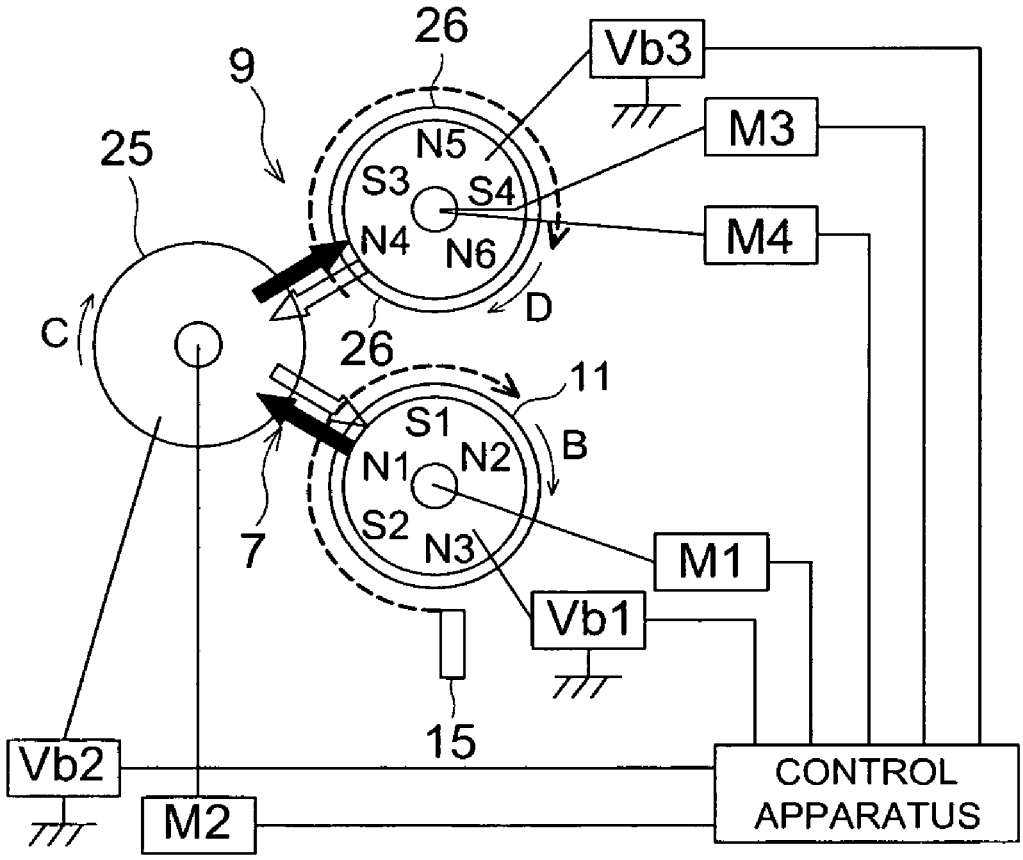
FIG. 5 is a schematic diagram showing another example of removing the accumulation of reverse polarity particles.

In a still another method, the accumulation of the reverse polarity particles can be released by adjusting the ability of feeding the developer from the first developer carrying member 11 to the second developer carrying member 26. To be more specific, as shown in FIG. 5, the drive section M4 for the magnetic roller inside the second developer carrying member 26 is controlled by the controller in such a way that the magnetic roller 28 inside the second developer carrying member 26 is rotated by a predetermined angle so that the homopolar sections N4 and N6 are located at the position opposite to the first developer carrying member 11, for example. This arrangement reduces the ability of feeding the developer from the first developer carrying member 11 to the second developer carrying member 26. Thus, the developer on the first developer carrying member 11 is directly collected into the developer container 16, whereby the accumulation of the reverse polarity particles is released.

The accumulation release operations have been described with reference to FIGS. 4*a*, 4*b*, 4*c* and 5. Since this operation is performed during the non-image-forming period, the supply of toner to the toner carrying member 25 or the collection of toner from the toner carrying member 25 may be performed or may not be performed. Further, for the same reason, the rotation of the toner carrying member 25 may be performed or may not be performed.

In the example of FIG. 2, the electrostatic force for the reverse polarity particles acts toward the first developer carrying member 11 during image-forming operation. In this case, as described above, a big oscillating field is formed between the toner carrying member 25 and the first developer carrying member 11 in order to collect into the developer as many reverse polarity particles deposited on the toner as possible. Thus, the reverse polarity particles having been isolated by the big oscillating field are attracted toward the first developer carrying member 11 by the electrostatic force.

Under such conditions, part of the reverse polarity particles collected into the developer is further moved onto the surface of the first developer carrying member 11 from the developer by the action of the electrostatic force thereof. Thus, when the developer is collected from the first developer carrying member 11 into the developer container 16 by the repulsive field of the homopolar sections N2 and N3, the developer may remain on the first developer carrying member 11.

This phenomenon is further promoted because the reverse polarity particles are applied with the electrostatic force directed toward the first developer carrying member 11 from the second developer carrying member 26, where the electrostatic force is generated by the first development bias applied to the first developer carrying member 11 from the power source Vb1, and the second development bias applied to the second developer carrying member 26 from the power source Vb3.

When accumulation is released as shown in FIGS. 4*a*, 4*b*, 4*c* and 5, the voltages of the power source Vb1 and power source Vb3 are preferably controlled by the controller to ensure that the reverse polarity particles will not be attracted toward the first developer carrying member 11 in the electric field between the first developer carrying member 11 and the second developer carrying member 26.

Further, when the voltages of the power source Vb1 and power source Vb3 are controlled by the controller, an oscillating electric field is formed between the first developer carrying member 11 and the second developer carrying member 26. Thus, the reverse polarity particles deposited on the surface of the first developer carrying member 11 are separated and can be collected into the developer container 16 together with the developer. The maximum electric field of the oscillating field in this case is preferably the same as the toner-supplying electric field.

Second Embodiment

Figure 6:
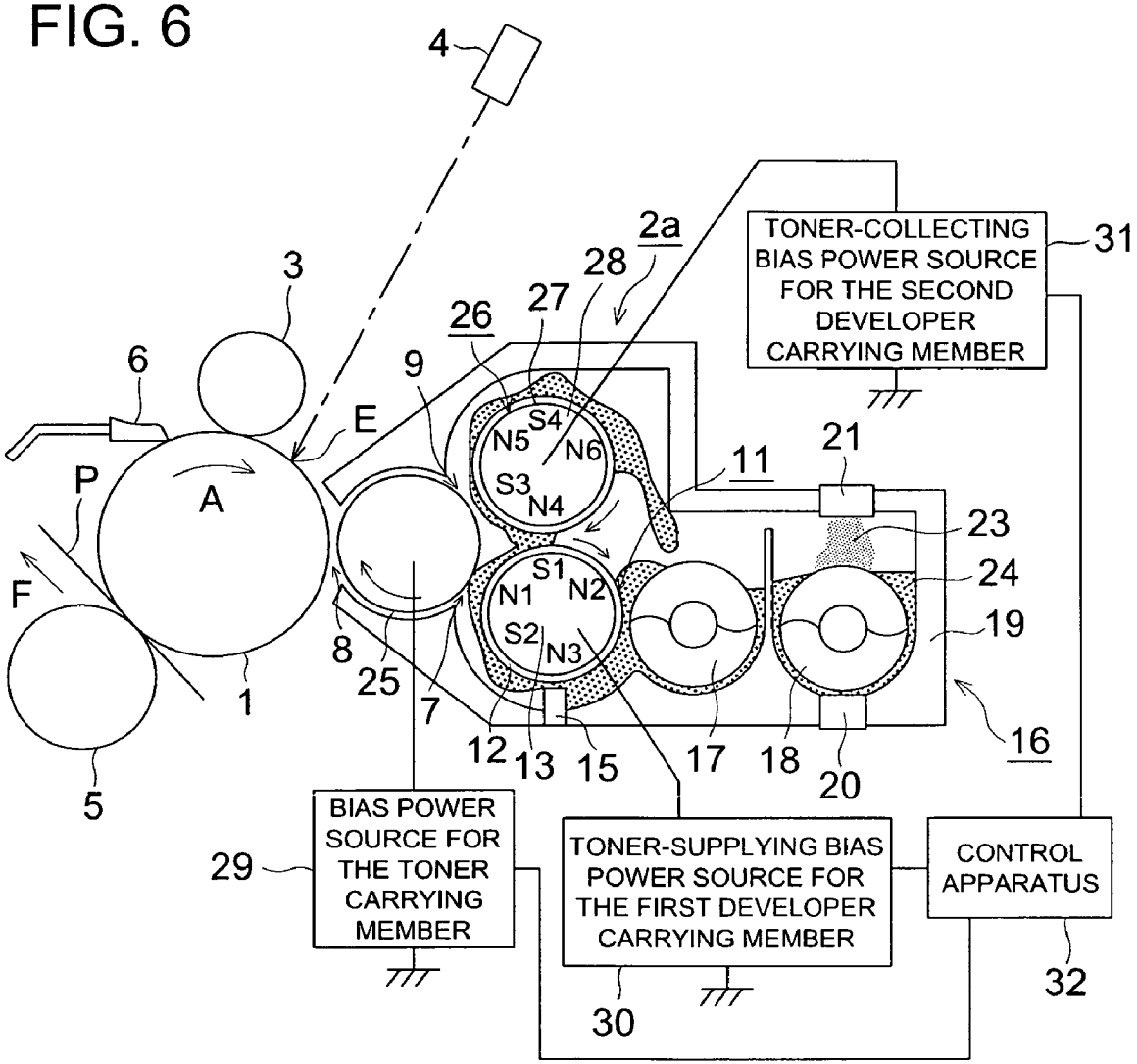
FIG. 6 is a schematic configuration diagram showing the major components of an image forming apparatus as a second embodiment according to the present invention.

FIG. 6 shows the major components of an image forming apparatus as a second embodiment of the present invention. The same components as those of the image forming apparatus in the first embodiment described with reference to FIG. 1 are assigned with the same symbols and the description thereof will be omitted.

The following describes the developing device 2*a* used in the present embodiment. The developing device 2*a* includes a developer 24 containing the reverse polarity particles; a developer container 16 for storing the same; (a first) developer carrying member 11 for toner supply that carries, the developer 24 supplied from the developer container, on its surface to convey them; a toner carrying member 25 wherein only the toner is supplied from the first developer carrying member 11 in the toner supply area 7, and the electrostatic latent image formed on the aforementioned image carrying member 1 is developed; (a second) developer carrying member 26 for toner collection that collects, in the toner collection area 9, the post-development toner remaining on the toner carrying member 25 after passing through the development area 8; a bias power source 29 for toner carrying member that supplies voltage to the toner carrying member 25; a bias power source 30 for the first developer carrying member that supplies voltage to the first developer carrying member 11; a bias power source 31 for the second developer carrying member that supplies voltage to the second developer carrying member 26; and a control apparatus 32 for controlling the power sources thereof and the drive of the carrying members.

As the developer 24 of the present embodiment, and the toner, carrier and reverse polarity particles contained in the developer 24, the same as those described with reference to the first embodiment can be used.

The first developer carrying member 11 is made up of a magnetic roller 13 fixed in position, and a freely rotatable sleeve roller 12 including the same therein. The toner supply bias for supplying toner to the toner carrying member 25 is applied by the bias power source 30 for the first developer carrying member. The magnetic roller 13 has five magnetic poles N1, S1, N2, N3 and S2 along the rotating direction of the sleeve roller 12. Of these magnetic poles, the major magnetic pole N1 is arranged in the toner supply area 7 opposite to the toner carrying member 25. Similarly, the second developer carrying member 26 is also made up of a magnetic roller 28 fixed in position, and a freely rotatable sleeve roller 27 including the same therein. The collection bias for collecting the post-development toner remaining on the toner carrying member 25 is applied from the bias power source 31 for the second developer carrying member. The magnetic roller 28 has five magnetic poles N4, S3, N5, S4 and N6 installed in the rotating direction of the sleeve roller 27. Of these magnetic poles, the major magnetic pole S3 is arranged in the toner collection area 9 opposed to the toner carrying member 25. The homopolar sections N6 and N4 which generate the repulsive field for separating the developer 24 from the sleeve roller 27 are arranged at the position facing inside the developer container 16. In order to feed the developer on the first developer carrying member 11 to the second developer carrying member 26, magnetic poles S1 and N4 are installed at the opposite positions of the first developer carrying member 11 and the second developer carrying member 26. The toner carrying member 25 is arranged to be opposite to each of the first developer carrying member 11, the second developer carrying member 26 and image carrying member 1. Development bias for developing the electrostatic latent image on the image carrying member 1 is applied from the bias power source 29 for toner carrying member. The toner carrying member 25 has the same structure as that of the first embodiment which has already been described.

The following describes the method of controlling the developing device 2*a* used in the present embodiment:

In the present embodiment, the image-forming period means the time period when residual toner on the toner carrying member 25 is collected by the second developer carrying member 26 prior to and corresponding to the time period when the toner for developing the electrostatic latent image formed on the image carrying member 1 is supplied to the toner carrying member 25 by the first developer carrying member 11. The non-image-forming period represents the time period other than the aforementioned image-forming period.

During the image-forming period, a bias is applied to the toner carrying member 25 and the first developer carrying member 11 so that an electric field is formed in the toner supply area 7 in the direction wherein toner is forced to move from the first developer carrying member 11 to the toner carrying member 25.

For example, assuming that the toner is negatively charged. In the toner supply area 7, the voltage lower than that of the toner carrying member 25 is applied to the first developer carrying member 11 in such a way that an electric field will be formed in the direction wherein toner is forced to move from the first developer carrying member 11 to the toner carrying member 25. Further, in the toner collection area 9, the voltage higher than that of the toner carrying member 25 is applied to the second developer carrying member 26 in such a way that an electric field is formed in the direction wherein the post-development toner remaining is forced to move from the toner carrying member 25 to the second developer carrying member 26. When the toner is positively charged, the voltages having a magnitude relation opposite to the aforementioned relation are applied.

A bias voltage with has a DC component superimposed with an AC bias can be applied as a bias voltage to one or more of the toner carrying member 25, the first developer carrying member 11 and the second developer carrying member 26. The AC waveform available in this case is exemplified by sinusoidal wave, rectangular wave, triangular wave and various forms of AC waveform. When the bias voltage having an AC component is to be used, the bias voltage should be set in such a way that the average value of the bias voltages in one period meets the requirements of the aforementioned magnitude relation.

When such a bias has been applied, the reverse polarity particles included in the developer are charged reverse to the toner, and therefore, receive the force in the direction reverse to that of toner.

Figure 7:
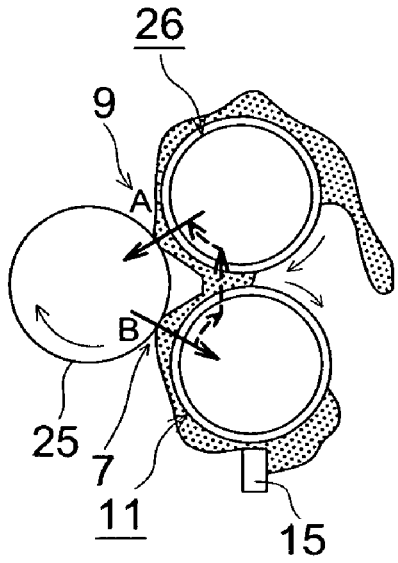
FIG. 7 is a pattern diagram showing the behavior of reverse polarity particles.

Referring to FIG. 7, the following describes the behavior of the reverse polarity particles during the image-forming period: The reverse polarity particles contained in the developer and having been conveyed on the first developer carrying member 11 are subjected to force B in the toner supply area 7. Accordingly, these particles are conveyed kept in the state of being contained in the developer, and are handed over to the second developer carrying member 26 together with the developer. The reverse polarity particles having been conveyed to the toner collection area 9 on the second developer carrying member 26 is subjected to the force in the direction of arrow A and are moved onto the toner carrying member 25. The particles are again moved to the toner supply area 7 by the rotation of the toner carrying member 25. In this case, reverse polarity particles are subjected to the force in the direction of arrow B, and therefore, are again put into the developer on the first developer carrying member 11. They are again conveyed together with the developer and are brought to the toner collection area 9.

The repetition of this operation causes the reverse polarity particles to circulate through the area enclosed by the toner carrying member 25, first developer carrying member 11, and developer carrying member 26 for collection, without going back to the developer container 16. This phenomenon always occurs to the developer to be conveyed during the formation of image. If this situation continues, a high proportion of the reverse polarity particles will accumulate in this area. Accordingly, the reverse polarity particles in the developer container 16 will be insufficient and the originally intended effect of suppressing the carrier deterioration cannot be achieved.

Thus, the present embodiment uses the following steps to perform the operation of collecting the reverse polarity particles: To ensure that reverse polarity particles stored during the image-forming period will be fed back to the developer container 16 at a predetermined cycle during the non-image-forming period, setting is performed in such a way that the bias applied to the toner carrying member 25 and that of the second developer carrying member 26 will have the same potential. Alternatively, setting is made in such a way that electric field is formed in the direction opposite to that in the image-forming period, thereby ensuring that reverse polarity particles do not move from the second developer carrying member 26 to the toner carrying member 25. The predetermined cycle can be assumed as, for example, a time period between one page and the next page of the transfer medium P, a time period after completion of one job, a time period after formation of images for a predetermined period of time, a time period between the last page of a predetermined number of pages and the first page of the next predetermined number of pages, a time period between one page and the next page after formation of images for a predetermined period of time, or a time period after completion of a job. This arrangement allows the reverse polarity particles to be contained in the developer and conveyed by the second developer carrying member 26. The reverse polarity particles are then separated by the separation section of the homopolar magnetizing sections N4 and N6 provided on the second developer carrying member 26, and are fed back to the developer container 16.

Figure 9:
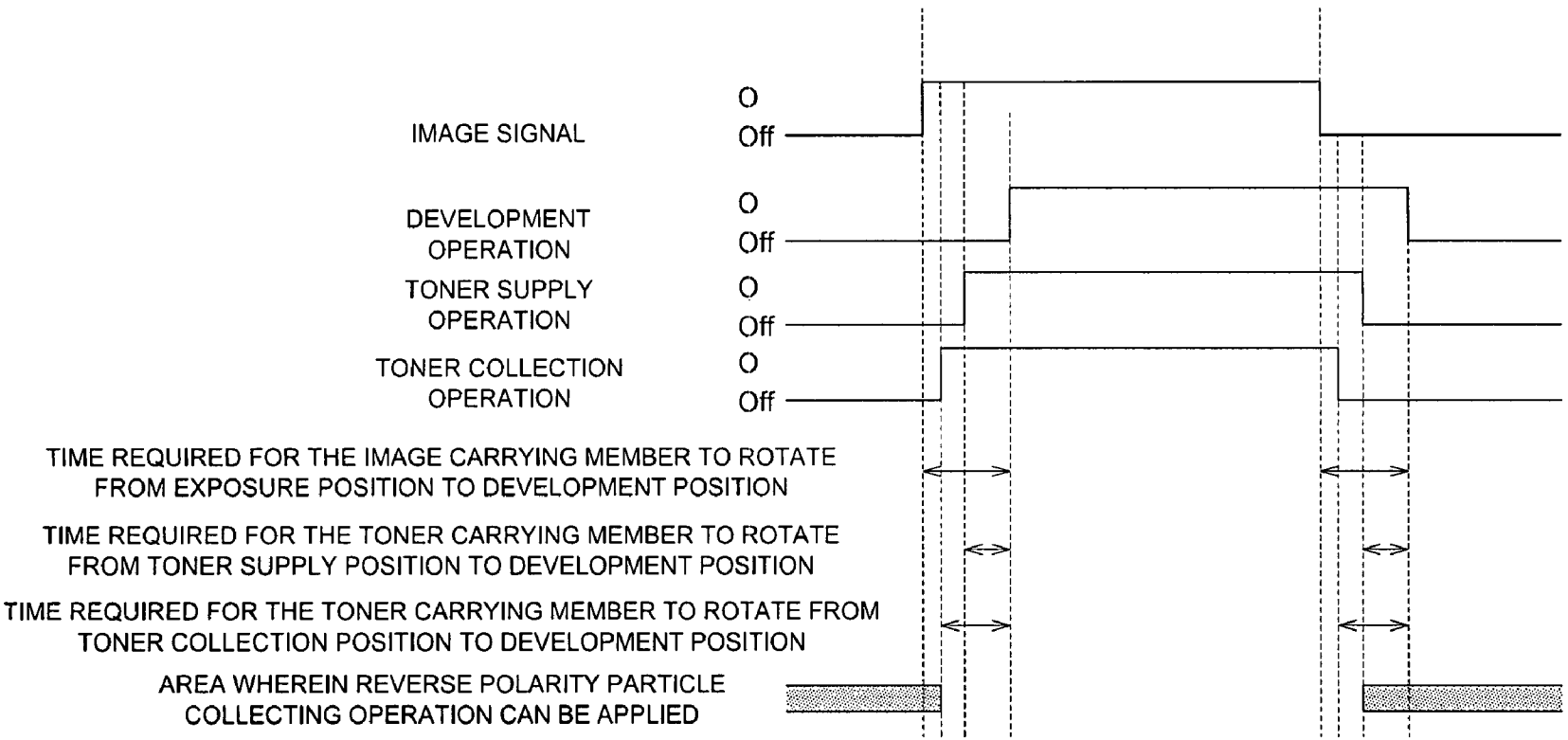
FIG. 9 is a schematic diagram showing the timing of a reverse polarity particle collecting operation.

The following describes the further details of the timing at which the reverse polarity particle collecting operation is executed: FIG. 9 shows the timing available for the operation of collecting the reverse polarity particles, in relation to other operations, when reverse polarity particles have been collected for each non-image-forming period between every page. The image signal shows whether or not a latent image is being written on the image carrying member 1 at the exposure position E. The operation of development represents the time duration when the latent image written by the image signal is being developed at the position of development. This operation is started with a delay time required for the image carrying member 1 to rotate from the exposure position to the development position. The toner supply operation represents the time when the first developer carrying member 11 is required to supply toner onto the toner carrying member 25 in order to perform the aforementioned development operation. This operation is performed in the time zone prior to the development operation by the time required for the toner carrying member 25 to rotate from the toner supply position to the development position. The toner collecting operation represents the time when the second developer carrying member 26 is required to collect the toner remaining on the toner carrying member 25. This is performed in the time zone prior to the development operation by the time required for the toner carrying member 25 to rotate from the toner recovery position to the development position.

FIG. 9 shows the area wherein reverse polarity particles can be collected without adversely affecting the image formation. To be more specific, just before and after starting image formation, the reverse polarity particle collecting operation must be completed before the toner collecting operation starts. If there is a delay, just before and after the start of toner collecting operation, there will appear two different portions; a portion wherein toner is supplied to the toner layer remaining on the toner carrying member 25, and a portion wherein toner is supplied on the position wherein the toner layer has been collected. This difference may produce noise on the image. Just before and after completion of image formation, the operation of collecting the reverse polarity particles must be started after completion of toner supply operation. If the operation starts earlier than that, the layer of the toner supplied onto the toner carrying member 25 may be adversely affected to produce noise on the image. It goes without saying that, as another embodiment different from this embodiment, even if the reverse polarity particle collecting operation is performed after completion of the toner collecting operation, the reverse polarity particle collecting operation can be started immediately after completion of toner collecting operation as long as the layer of the toner supplied on the toner carrying member 25 in the toner supply operation is not adversely affected.

Figure 8:
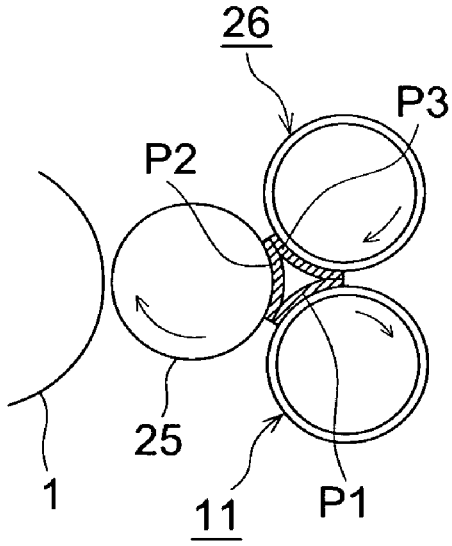
FIG. 8 is a pattern diagram showing the operation of collecting reverse polarity particles.

The aforementioned operation of collecting the reverse polarity particles ensures that the reverse polarity particles in the area P1 on the first developer carrying member 11 and area P3 on the second developer carrying member in FIG. 8 are collected into the developer container 16.

The control apparatus 32 controls the bias power source 29 for the toner carrying member and the bias power source 31 for the second developer carrying member in such a way that the toner carrying member 25 and the second developer carrying member 26 have the same potential during the non-image-forming period, or an electric field is formed in the direction opposite to that during the image-forming period, whereby reverse polarity particle collecting operation is performed.

To collect the reverse polarity particles in the area P2 on the toner carrying member 25 of FIG. 8, a bias during the operation of collecting the reverse polarity particle collecting operation is preferably set such that the reverse polarity particles move from the toner carrying member 25 to the first developer carrying member 11. This arrangement allows a greater number of reverse polarity particles to be fed back into the development container 16, whereby better images can be formed over a longer period of time.

Further, the following arrangement can also be used: During the operation of collecting the reverse polarity particles, the rotating direction of the toner carrying member 25 is switched over to the direction opposite to that in the image-forming period, and the bias power source 29 for toner carrying member and the bias power source 31 for the second developer carrying member is set in such a way that the potential of the toner carrying member 25 and that of the second developer carrying member 26 form an electric field in the direction wherein the reverse polarity particles move from toner carrying member 25 to the second developer carrying member 26, thereby collecting the reverse polarity particles in the area P2 on the toner carrying member 25. This arrangement preferably ensures the reverse polarity particles in the areas P1 through P3 of FIG. 8 to be collected.

Figure 10:
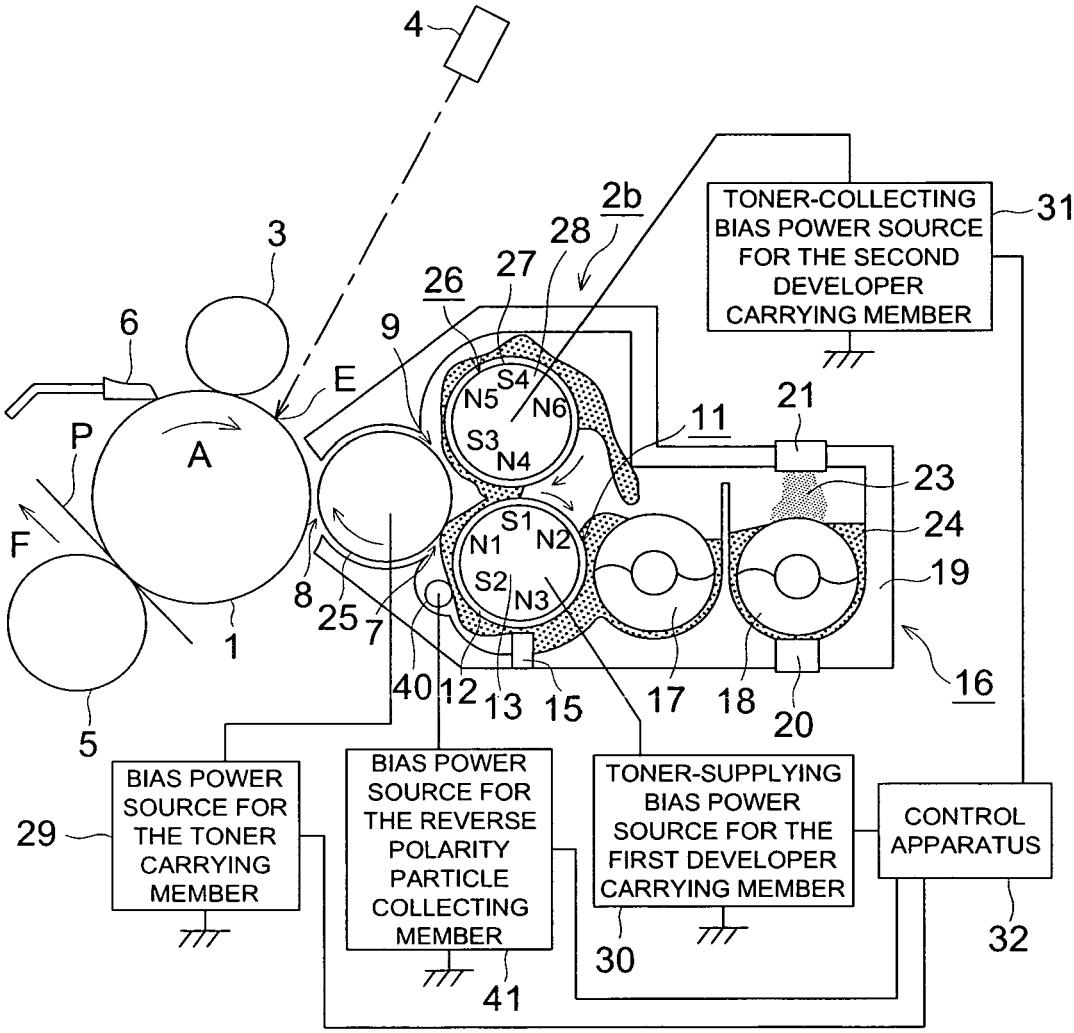
FIG. 10 is an schematic configuration diagram showing the major components of an modified example of the second embodiment according to the present invention.

FIG. 10 shows the major components of an image forming apparatus in the variation of the second embodiment. In FIG. 10, the same components as those of FIG. 1 or 6 are assigned with the same symbols and the description thereof will be omitted.

The developing device 2*b* of FIG. 10 is provided with a reverse polarity particle collecting member 40 opposite to the first developer carrying member 11 and a bias power source 41 for the reverse polarity particle collecting member to apply a bias thereto, in addition to the developing device 2*a* of FIG. 6. The reverse polarity particle collecting member 40 is disposed at the position opposite to the first developer carrying member 11, on the upstream side in the rotating direction of the first developer carrying member 11 with respect to the position wherein the toner carrying member 25 and the first developer carrying member 11 are opposed.

During the image-forming period, the reverse polarity particle collecting member 40 separates the reverse polarity particles from the developer on the first developer carrying member 11 by means of bias, and carries them on the surface thereof. During the non-image-forming period, the reverse polarity particles carried thereon are returned to the developer on the first developer carrying member 11 by switching the applied biases at a predetermined cycle.

During the image-forming period, bias is applied in such a direction that reverse polarity particles move from the first developer carrying member 11 to the reverse polarity particle collecting member 40. The toner is assumed to be negatively charged for the sake of explanation and a bias should be applied to the reverse polarity particle collecting member 40 so that the potential will be lower than that of the first developer carrying member 11. The DC component with an AC bias superimposed thereon is used as the bias. Various forms of AC waveforms such as sinusoidal wave, rectangular wave and triangular wave can be used as the AC waveform in this case. When such AC waveforms are used, the biases should be set in such a way that the average values of the bias voltages in one cycle meet the requirements of the aforementioned magnitude relation of voltages.

The following describes how the operation of collecting the reverse polarity particles is controlled: In order to return, the reverse polarity particles having been accumulated by the reverse polarity particle collecting member 40 during the image-forming period, into the developer container 16 at a predetermined cycle during the non-image-forming period, biases are applied to the reverse polarity particle collecting member 40 and the first developer carrying member 11 in such a way that an electric field is formed in the direction, an electric field in which direction causes the reverse polarity particles to move from the reverse polarity particle collecting member 40 to the first developer carrying member 11. Further, setting is provided in such a way that the bias applied to the toner carrying member 25 and that applied to the second developer carrying member 11 have the same potential, or electric field will be formed in the direction opposite to that during the image-forming period.

The collection of the reverse polarity particles can be executed at the predetermined cycle at the timing, for example, between every page of the transfer medium, after completion of one job, after formation of images for a predetermined period of time, between every bunch of a predetermined number of pages, between one page and the next page after formation of images for a predetermined period of time, or after completion of a job. This arrangement allows the reverse polarity particles to be brought into the developer on the first developer carrying member 11 from the reverse polarity particle collecting member 40, to be conveyed to the second developer carrying member 26 without being transfered to the toner carrying member 25, to be conveyed to the separation section of the homopolar magnetizing sections N4 and N6 provided on the second developer carrying member 26, and to be fed back to the developer container 16.

The biases applied to various sections during the operation of collecting the reverse polarity particles is only required to meet the aforementioned relationship, and can be independent of the setting during the image-forming period. The bias of the toner carrying member 25 applied during the image-forming period can be suspended during the operation of collecting the reverse polarity particles and other biases can be set so as to meet the aforementioned relationship. A DC component with an AC bias superimposed thereon can be used as a bias. Various forms of AC waveforms such as sinusoidal wave, rectangular wave and triangular wave can be used as the AC waveform in this case. When such AC waveforms are used, the biases should be set in such a way that the average values of bias voltages in one cycle meet the requirements of the aforementioned magnitude relation of voltages.

Further, the drive of the toner carrying member need not be the same as that during the image-forming period. It can be suspended, without any problem in the recovery of the reverse polarity particles.

In this variation example, the reverse polarity particle collecting member 40 opposite to the first developer carrying member 11 is arranged on the upstream side from the toner supply area 7. During the image-forming period, reverse polarity particles are collected from the developer on the first developer carrying member 11. The bias power source 30 for the first developer carrying member and bias power source 41 for the reverse polarity particle collecting member are controlled in such a way that, during the operation of collecting the reverse polarity particles, the potential of the reverse polarity particle collecting member 40 and that of the first developer carrying member 11 form an electric field in the direction opposite to that during the image-forming period. This arrangement ensures more reliable step of returning the reverse polarity particles into the developer container 16, and provides a developing device and image forming apparatus which are free from ghost for a longer period of time and capable of offering the advantage of minimizing the deterioration of a carrier.

As will be apparent from the above description, the operation of releasing the accumulation of reverse polarity particles is performed at a timing without adversely affecting image formation, whereby the unwanted reverse polarity particles accumulated between the toner carrying member 25, the first developer carrying member 11 and the second developer carrying member 26 can be collected adequately and effectively collected into the developer container 16. This arrangement provides a high-quality image with the minimum development hysteresis (image memory), and also ensures the advantage of stabilizing the image quality by suppressing the reduction in the toner charge by means of the carrier charging capacity being encouraged by reverse polarity particles. Thus, high-quality images are ensured for a long period of time.

What is claimed is:

1. An image forming apparatus, comprising:

an image carrying member which is adapted to carry an electrostatic latent image;

a developer container which is adapted to contain a developer including a toner, a carrier for charging the toner, and reverse polarity particles to be charged reverse to a charge polarity of the toner;

a toner carrying member which is adapted to convey a toner to a development position, at which the toner carrying member faces the image carrying member, to develop the electrostatic latent image on the image carrying member;

a first developer carrying member which is adapted to carry the developer supplied from the developer container and is disposed facing the toner carrying member to supply a toner to the toner carrying member;

a second developer carrying member which is adapted to carry a developer and is disposed, to collect the toner on the toner carrying member, facing the toner carrying member at an upstream side position from the first developer carrying member in a direction in which the toner carrying member conveys the toner;

a controller which is adapted to cause a collecting operation to be executed in which reverse polarity particles remaining in a region surrounded by the toner carrying member, the first developer carrying member and the second developer carrying member are conveyed to the developer container at a timing at which development of the electrostatic latent image is not affected by the collecting operation, wherein when the collecting operation is being executed, the controller causes the first developer carrying member to convey the developer thereon to the developer container, and during a period in which the development of the electrostatic latent image is executed, the controller causes a developer, which exists on the first developer carrying member and from which a toner has been supplied to the toner carrying member, to move onto the second developer carrying member.

2. The image forming apparatus of claim 1, wherein when the collecting operation is being executed, the controller causes the second developer carrying member to move at a moving speed slower than a moving speed of the first developer carrying member.

3. The image forming apparatus of claim 2, wherein the controller stops the second developer carrying member when the collecting operation is being executed.

4. The image forming apparatus of claim 1, wherein the controller causes the second developer carrying member to move in a reverse direction when the collecting operation is being executed.

5. The image forming apparatus of claim 1, wherein the second developer carrying member includes: a plurality of magnetic poles therein; and a sleeve which is rotatably supported around a circumference of the magnetic poles, wherein the controller causes the magnetic poles to move when the collecting operation is executed.

6. The image forming apparatus of claim 5, wherein at least one adjacent pair of the magnetic poles have the same polarity, and when the collecting operation is executed, the controller causes the pair of magnetic poles of the same polarity to move to a position at which the pair of magnetic poles of the same polarity face the first developer carrying member.

7. The image forming apparatus of claim 1, wherein the controller changes an average of an electric field formed between the first developer carrying member and the second developer carrying member when the collecting operation is executed.

8. The image forming apparatus of claim 7, wherein when the collecting operation is being executed, the controller causes an average of each of a voltage applied to the first developer carrying member and a voltage applied to the second developer carrying member to have the same value.

9. The image forming apparatus of claim 7, wherein the electric field formed between the first developer carrying member and the second developer carrying member is a vibrating electric field.

10. The image forming apparatus of claim 1, wherein when the collecting operation is being executed, the controller operates such that the toner carrying member and the second developer carrying member are supplied with voltages which form, between the toner carrying member and the second developer carrying member, either no electric field or an electric field having a direction opposite to a direction during development of the electrostatic latent image.

11. The image forming apparatus of claim 10, wherein when the collecting operation is being executed, the controller controls the voltage applied on the toner carrying member and the voltage applied on the first developer carrying member such that the voltages form an electric field in a direction wherein the electric field causes the reverse polarity particles to move from the toner carrying member onto the first developer carrying member.

12. The image forming apparatus of claim 10, wherein when the collecting operation is being executed, the controller causes the toner carrying member to move in a direction opposite to a direction during development of the electrostatic latent image.

13. The image forming apparatus of claim 12, wherein the reverse polarity particles have a number average particle diameter of from 100 to 1000 nm.

14. An image forming apparatus, comprising:

an image carrying member which is adapted to carry an electrostatic latent image;

a developer container which is adapted to contain a developer including a toner, a carrier for charging the toner, and reverse polarity particles to be charged reverse to a charge polarity of the toner;

a toner carrying member which is adapted to convey a toner to a development position at which the toner carrying member faces the image carrying member to develop the electrostatic latent image on the image carrying member;

a first developer carrying member which is adapted to carry the developer supplied from the developer container and is disposed facing the toner carrying member to supply a toner to the toner carrying member;

a second developer carrying member which is adapted to carry a developer and is disposed, to collect the toner on the toner carrying member, facing the toner carrying member at an upstream side position from the first developer carrying member in a direction in which the toner carrying member conveys the toner;

a reverse polarity particle collecting member which is provided at an upstream side, from the toner carrying member, in a direction in which the first developer carrying member conveys the developer; and a controller which is adapted to set, in a case of developing the electrostatic latent image, an electric field between the first developer carrying member and the reverse polarity particle collecting member in a direction wherein the electric field causes the reverse polarity particles to move from the first developer carrying member onto the reverse polarity particle collecting member, and to set, at a timing at which development of the electrostatic latent image is not affected, the electric field in a direction wherein the electric field causes the reverse polarity particles to move from the reverse polarity particle collecting member onto the first developer carrying member.

15. The image forming apparatus of claim 14, wherein the reverse polarity particles have a number average particle diameter of from 100 to 1000 nm.

16. An image forming apparatus, comprising:

an image carrying member which is adapted to carry an electrostatic latent image;

a developer container which is adapted to contain a developer including a toner, a carrier for charging the toner, and reverse polarity particles to be charged reverse to a charge polarity of the toner;

a toner carrying member which is adapted to convey a toner to a development position at which the toner carrying member faces the image carrying member to develop the electrostatic latent image on the image carrying member;

a first developer carrying member which is adapted to carry the developer supplied from the developer container and is disposed facing the toner carrying member to supply a toner to the toner carrying member;

a second developer carrying member which is adapted to carry a developer and is disposed, to collect the toner on the toner carrying member, facing the toner carrying member at an upstream side position from the first developer carrying member in a direction in which the toner carrying member conveys the toner; and a controller which is adapted to set, in a case of developing the electrostatic latent image, an electric field between the toner carrying member and the second developer carrying member such that the electric field causes the toner to move from the toner carrying member onto the second developer carrying member, and set, in a case of executing a collecting operation for collecting reverse polarity particles, the electric field between the toner carrying member and the second developer carrying member such that the electric field causes the reveres polarity particles to move from the toner carrying member onto the second developer carrying member at a timing at which the developing of the electrostatic latent image is not affected by the collecting operation.

17. The image forming apparatus of claim 16, wherein when the collecting operation is being executed, the controller causes the toner carrying member to move in a direction opposite to a direction during development of the electrostatic latent image.

18. The image forming apparatus of claim 16, wherein the reverse polarity particles have a number average particle diameter of from 100 to 1000 nm.

* * * * *